United States Patent [19]

Livecchi et al.

[11] Patent Number: 4,827,981

[45] Date of Patent: May 9, 1989

[54] FAIL-FIXED SERVOVALVE WITH CONTROLLED HARD-OVER LEAKAGE

[75] Inventors: Ronald J. Livecchi, Clearwater; Donald J. Peters, St. Petersburg, both of Fla.

[73] Assignee: Moog Inc., East Aurora, N.Y.

[21] Appl. No.: 233,440

[22] PCT Filed: Jan. 25, 1988

[86] PCT No.: PCT/US88/00195

§ 371 Date: Aug. 9, 1988

§ 102(e) Date: Aug. 9, 1988

[87] PCT Pub. No.: WO88/04367

PCT Pub. Date: Jun. 16, 1988

[51] Int. Cl.[4] ..... F15B 13/043; F15B 20/00

[52] U.S. Cl. ..... 137/625.69; 137/625.64

[58] Field of Search ..... 137/625.64, 625.69

[56] References Cited

U.S. PATENT DOCUMENTS

| | | | |
|---|---|---|---|
| 3,023,782 | 3/1962 | Chaves et al. . | |
| 3,542,051 | 11/1970 | McFadden et al. . | |
| 3,612,103 | 10/1971 | Waddington | 137/625.63 |
| 3,922,955 | 12/1975 | Kast | 91/461 |
| 4,227,443 | 10/1980 | Toot | 91/459 |

OTHER PUBLICATIONS

Technical Bulletin 103, "Transfer Functions for Moog Servovalves", Moog Inc., (1965).

Abex Brochure on "fail-fixed servovalves", (date unknown).

*Primary Examiner*—Gerald A. Michalsky

*Attorney, Agent, or Firm*—Sommer & Sommer

[57] ABSTRACT

The second stage (10) of a fail-fixed flow-control servovalve has a five-lobed valve spool (12) slidably mounted in a body bore (19). At null, the end lobes (41,45) are substantially zero-lapped with respect to supply pressure slots (22,26), the middle lobe (43) is substantially zero-lapped with respect to a pair of return slots (23,24), and the intermediate control lobes (42,45) are both symmetrically underlapped with respect to their associated control slots (29,30). Stops (34,35) limit movement of the spool in either axial direction. When the spool is at null or in either hard-over position, deliberate flow with respect to the control slots is blocked, and relative leakage flows are controlled. Such leakage flows may be balanced such that there is substantially-zero net leakage flow with respect to each control slots. Alternatively, such leakage flows may be deliberately mismatched to provide for desired net leakage flows with respect to control slots.

14 Claims, 5 Drawing Sheets

Fig. 1.
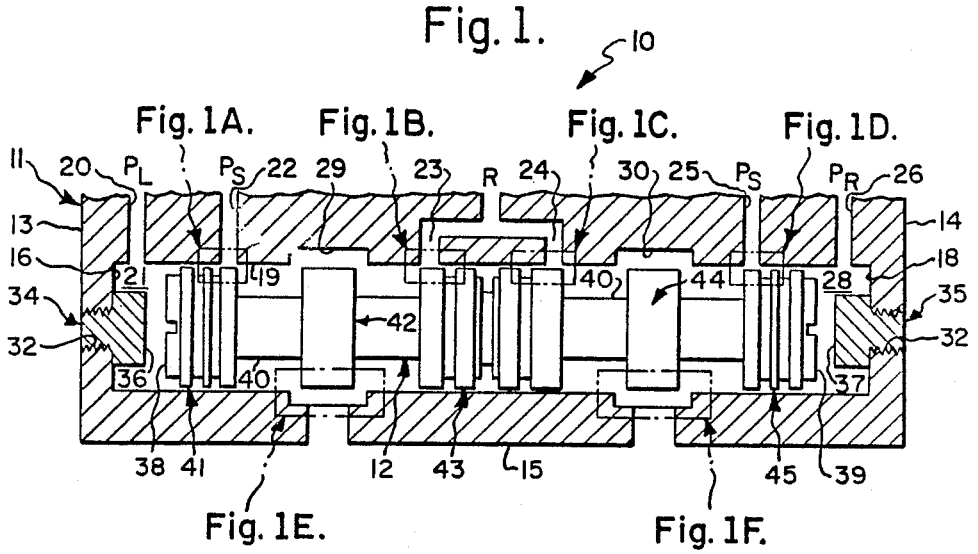
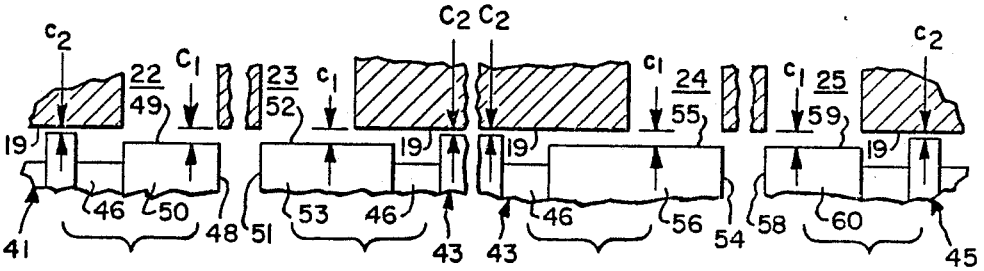
Fig. 1A. Fig. 1B. Fig. 1C. Fig. 1D.
Fig. 1E.
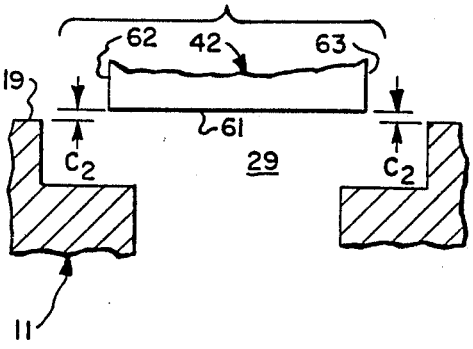
Fig. 1F.
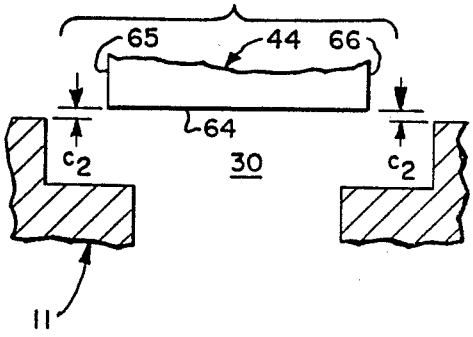

Fig. 2.
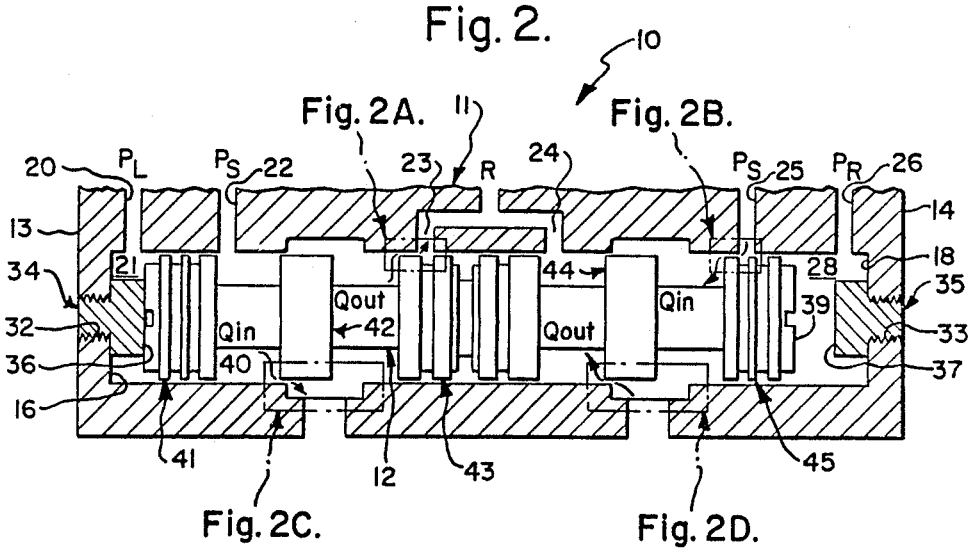
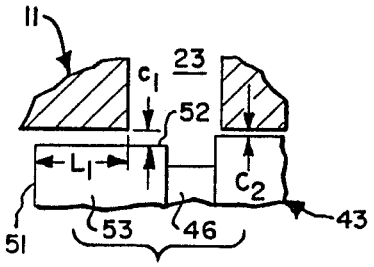
Fig. 2A.
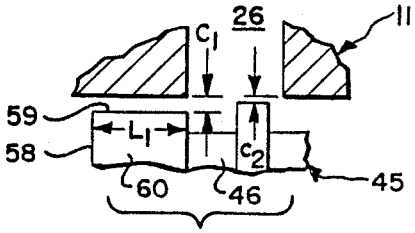
Fig. 2B.
Fig. 2C.
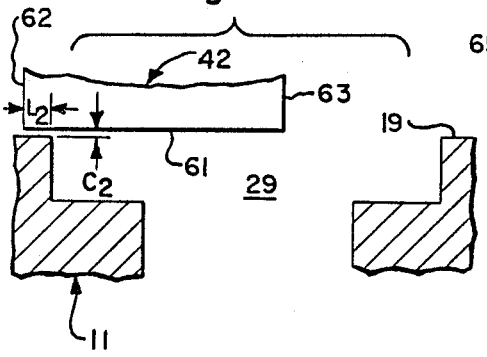
Fig. 2D.
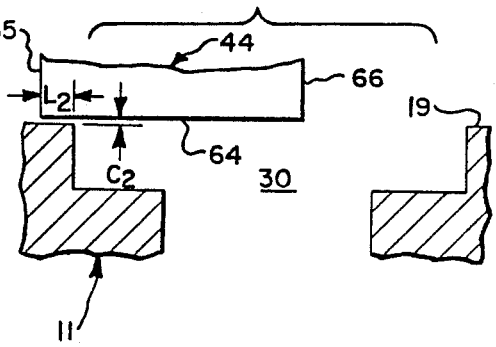

Fig. 3.
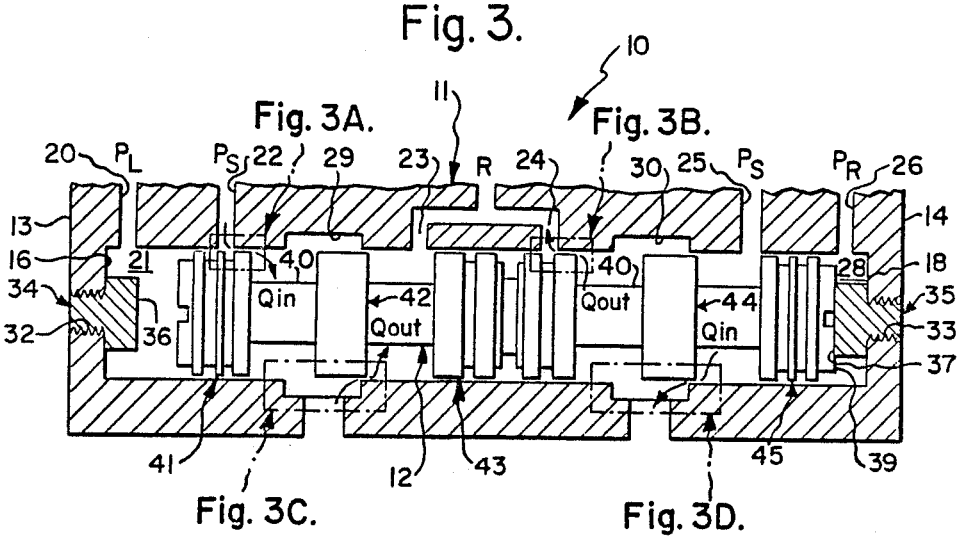
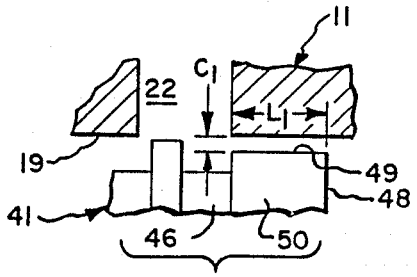
Fig. 3A.
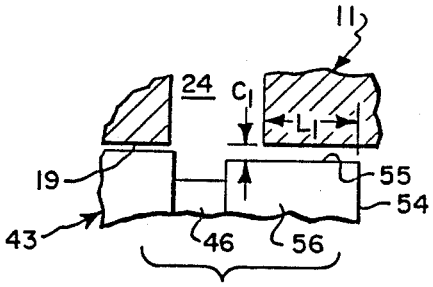
Fig. 3B.
Fig. 3C.
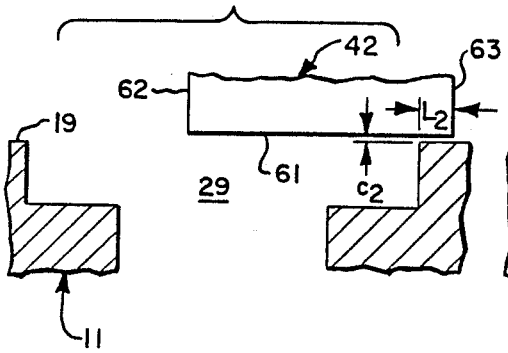
Fig. 3D.
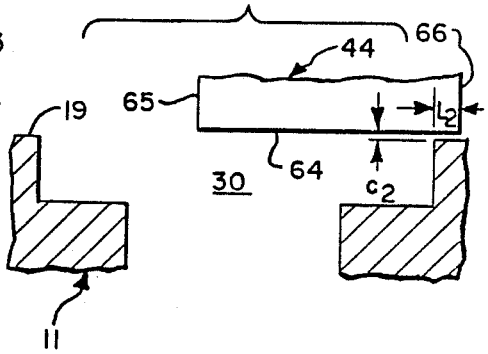

FAIL-FIXED SERVOVALVE WITH CONTROLLED HARD-OVER LEAKAGE

TECHNICAL FIELD

The present invention relates generally to the field of twostage electrohydraulic servovalves, and, more particularly, to a fail-fixed servovalve having an improved second-stage spool valve which, when in a hard-over position, deliberately controls the leakage flows to and from a control slot communicating with a load.

BACKGROUND ART

A two-stage electrohydraulic servovalve is a device for converting an electrical input into a substantially-proportional hydraulic output. Such servovalves typically have a first-stage hydraulic amplifier, and seconds-tage valve spool. The first-stage commonly has a torque motor arranged to produce pivotal movement of a member in response to a supplied electrical current. The hydraulic amplifier may be of the "nozzle-flapper" type (see, e.g., U.S. Pat. No. 3,023,782), the "jet pipe" type (see, e.g., U.S. Pat. No. 3,922,955), or the "deflectable jet stream" type (see, e.g., U.S. Pat. No. 3,542,051 and 3,612,103). In any event, the hydraulic amplifier is used to prdouce a differential pressure, which is then used to selectively shift the second-stage valve spool in the appropriate direction relative to the body. It is also known to provide a mechanical feedback spring wire between the second-stage spool and the torque motor pivotal member such that spool displacement off null will be substantially proportional to the polarity and magnitude of the supplied current.

Such servovalves may be further classified by the nature of the output. For example, in a "flow control" servovalve, output flow is substantially proportional to supplied current, at constant load. In a "pressure control" servovalve, the hydraulic output is a differential pressure. Other types include "pressure-flow" (PQ) servovalves, "dynamic pressure feedback" (DPF) servovalves, static load error washout (SLEW) servovalves, and "acceleration switching" (AS) servovalves. These various types and configurations are comparatively illustrated in Technical Bulletin 103, "Transfer Functions for Moog Servovalves", Moog Inc. (1965).

Servosystems, in which such servovalves are employed, may fail by virtue of a loss or interruption of the supplied system pressure, or by virtue of an upstream electrical malfunction. For example, if there is an interruption of the supplied current (i.e., $i=0$), then the servovalve may return to a null condition. On the other hand, there may be an aberration in the upstream electrical system such that a maximum or saturation current (i.e., $i=\pm i_{max}$) will be supplied to the servovalve. In this case, the second-stage spool will be driven in the appropriate direction toward a hard-over position so as to produce the maximum hydraulic output. If used to control the position of an airfoil surface, for example, such a hard-over failure can have disastrous consequences.

Hence, fail-fixed servovalves have been developed, as representatively shown and described in U.S. Pat. No. 3,922,955. In this type of servovalve, the hydraulic output is substantially proportional to supplied electrical current within a particular operating range of spool displacement off null. Thus, within this range, the valve functions normally as a conventional servovalve. However, abutment stops are provided on the body to limit spool displacement in either direction, and the spool is appropriately configured to recreate null-like hydraulic conditions if the spool moves to either hard-over position.

However, even when the spool is in such a hard-over position, there are still leakage flows across the various spool lobes. Upon information and belief, persons skilled in this art have heretofore attempted to minimize such leakage flows by more accurately machining the various metering and facing surfaces of the spool and body. In some applications, it may be desirable to have zero net leakage flow with respect to a control port, in the event of a hard-over failure. In others, it may be desirable to deliberately have a positive or negative net leakage flow with respect to such port in the event of such a failure. For example, such deliberate net leakage flow may be employed to slew a fluid-powered actuator toward a predetermined position.

DISCLOSURE OF THE INVENTION

This invention provides an improved fail-fixed servovalve with the further feature of having controlled leakage flows, or impedance to such leakage flows, in a hard-over condition. Such flow impedances may be deliberately balanced (i.e., $Q_{in}=Q_{out}$) such that there is substantially no net leakage flow to the actuator, or may be deliberately mismatched (i.e., $Q_{in}>Q_{out}$, or $Q_{in}<Q_{out}$) such that there will be a net leakage flow to or from the actuator.

In one aspect, the invention provides an improvement for a valve having a body provided with a bore; having supply, control and return slots extending into the body from the bore; the supply and return slots communicating with a source of pressurized fluid and a fluid return, respectively; having a valve spool slidably mounted in the bore for axial movement in at least one direction between a null position and an alternative position; the spool having supply, control and return lobes arranged to cooperate with the supply, control and return slots, respectively; each lobe being so configured and arranged such that, when the spool is moved from the null position toward the alternative position, fluid is constrained to flow between the control slot and one of the supply and return slots by passing sequentially through two variable orifices, the areas of which vary inversely with spool displacement off null. In this aspect, the improvement comprises: the control lobe and at least one of the supply and return lobes being so dimensioned and proportioned with rspect to their associated slots that when the spool valve is in the alternative position, one of the supply and return slots is opened, the other of such slots is closed, and the control lobe blocks intended flow between the control slot and such opened slots, and the ratio of impedance to leakage flows (i.e., $Q_{in}/Q_{out}$) to and from the control slot will be substantially equal to a predetermined value. As indicated above, this ratio may be less than, equal to, or greater than one, as desired.

Accordingly, the general object of the invention is to provide an improved fail-fixed servovalve.

Another object is to provide an improved fail-fixed servovalve in which the impedances to leakage flows to and from a control slot are deliberately controlled.

Another object is to provide an improved spool valve in which the impedances to leakage flow are deliberately controlled when the spool is in a predetermined position relative to the body.

These and other objects and advantages will become apparent from the foregoing and ongoing written specification, the drawings and the appended claims.

BRIEF DESCRIPTION OF THE DRAWINGS

FIG. 1 is a fragmentary schematic longitudinal vertical sectional view of an improved second-stage spool valve of a two-stage electrohydraulic servovalve, this view showing the spool as being in a centered or null position relative to the body.

FIG. 1A is an enlarged detail view of the spool left supply lobe and slot shown in FIG. 1.

FIG. 1B is an enlarged detail view of the spool middle lobe and left return slot shown in FIG. 1.

FIG. 1C is an enlarged detail view of the spool middle lobe and right return slot, shown in FIG. 1.

FIG. 1D is an enlarged detail view of the spool right supply lobe and slot shown in FIG. 1.

FIG. 1E is an enlarged detail view of the left control lobe and slot shown in FIG. 1.

FIG. 1F is an enlarged detail view of the right control lobe and slot shown in FIG. 1.

FIG. 2 is a view similar to FIG. 1, but shows the spool as having been shifted leftwardly to a hard-over position relative to the body.

FIG. 2A is an enlarged detail view of the spool middle lobe and left return slot as shown in FIG. 2.

FIG. 2B is an enlarged detail view of the spool right supply lobe and slot shown in FIG. 2.

FIG. 2C is an enlarged detail view of the left control lobe and slot shown in FIG. 2.

FIG. 2D is an enlarged detail view of the right control lobe and slot shown in FIG. 2.

FIG. 3 is a view similar to FIG. 1, but shows the spool as having been shifted righwardly relative to the body to a hard-over position.

FIG. 3A is an enlarged detail view of the left supply lobe and slot shown in FIG. 3.

FIG. 3B is an enlarged detail view of the spool middle lobe and right return slot shown in FIG. 3.

FIG. 3C is an enlarged detail view of the left control lobe and slot shown in FIG. 3.

FIG. 3D is an enlarged detail view of the right control lobe and slot shown in FIG. 3.

MODE(S) OF CARRYING OUT THE INVENTION

Figure 4:
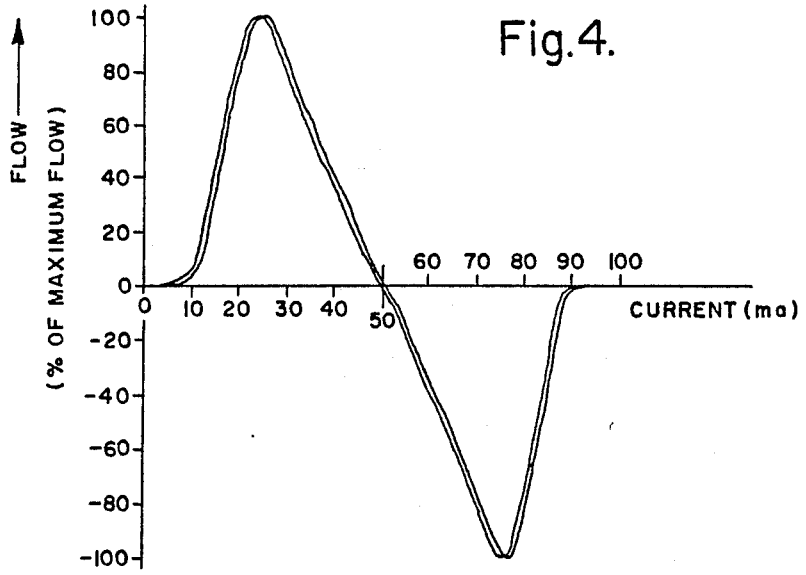
FIG. 4 is a graph showing flow (ordinate) verses supplied current (abscissa) for a fail-fixed servovalve with balanced leakage flows.

At the outset, it should be clearly understood that like reference numerals are intended to identify the same structural elements, portions, or surfaces consistently throughout the several drawing figures, as such elements, portions or surfaces may be further described or explained by the entire written specification, of which this detailed description is an integral part. Unless otherwise indicated, the drawings are intended to be read (e.g. cross-hatching, arrangement of parts, proportion, degree, etc.) together with the specification, and are intended to be considered a portion of the entire written description of this invention. As used in the following description, the terms "horizontal", "vertical", "left", "right", "up" and "down", as well as adjectival and adverbial derivatives thereof (e.g. "horizontally", "rightwardly", "upwardly", etc.) simply refer to orientation of the illustrated structure as the particular drawing figure faces the reader. similarly, the terms "inwardly" and "outwardly" generally refer to the orientation of a surface relative to its axis of elongation, or axis of rotation, as appropriate.

Referring now to the drawings, and, more particularly to FIG. 1 thereof, an improved second-stage spool valve, generally indicated at 10, of a two-stage flow-control electrohydraulic servovalve (not fully shown), of the type depicted in U.S. Pat. No. 3,023,782, is depicted as broadly including a body 11 provided with a horizontally-elongated bore, and a five-lobed valve spool 12 mounted for sealing sliding movement along the bore.

More particularly, the body is shown as having planar vertical left and right end faces 13,14, respectively, and a planar horizontal lower surface 15. The bore is bounded by annular vertical left and right end walls 16,18, respectively, and by an elongated inwardly-facing horizontal cylindrical surface 19 extending therebetween.

A number of axially-spaced slot-like pasageways extend into the body from bore wall 19. These various passageways may open onto the bore in the form of one or more discrete, angularly-segmented substantially-rectangular slots, or may be in the form of annular grooves, or may have some other shape, as desired. Thus, proceeding from left-to-right in FIG. 1, a first slotand-passageway 20 communicates spool left and chamber 21 with a source (not shown) of fluid at pressure $P_L$; a second slot-and-passageway 22 communicates the bore with a source (not shown) pressurized fluid at supply pressure $P_S$; a third slot-and-passageway 23 communicates the bore with a fluid return or sump (not shown) at a return pressure R; a fourth slot-and-passageway 24 communicates the bore with the fluid return; a fifth slot-and-passageway 25 communicates the bore with the source (not shown) of fluid at supply pressure $P_S$; and the rightwardmost sixth slot-and-passageway 26 communicates the spool right end chamber 28 with another source of fluid at pressure $P_R$. Pressures $P_L$ and $P_R$ may be provided by the servovalve amplifier section (not shown), and are selectively variable to create a pressure differential adequate to shift the spool either leftwardly or rightwardly, as desired, relative to the body. Additional details as to the structure and basic operation of such a "flow control" servovalve may be found in U.S. Pat. No. 3,023,782, the aggregate disclosure of which is hereby incorporated by reference. Passageways 22,25 may communicate with the same fluid source, or with different fluid sources, as desired. Similarly, return passageways 23,24 may communicate with a common return, or with different returns or sumps, as desired. For the purposes of illustration, however, passageways 22,25 are both provided with the same supply pressure $P_S$, and return passageways 23,24 both communicate with a common return. Alternatively, the respective pressures in passageways 22,23,24,25 could be different from those specifically shown. Thus, six passageways extend into the body from a like number of axially-spaced radial slots, which open onto bore surface 19. the body is further provided with left and right control slots or grooves 29,30, which extend radially into the body from bore surface 19 between slots 22,23, and 24,25, respectively.

Still referring principally to FIG. 1, tapped horizontal axial holes 32,33 communicate body surfaces 13,16 and 18,14, respectively. These holes matingly receive the threaded shank portions of left and right abutment stops 34,35, respectively. Thus, by selectively rotating these stops relative to the body, the axial spacing of the spool-facing abutment surfaces 36,37 thereof may be varied. Hence, the abutment stops are adjustably mounted on the body. The structure of these abutment stops has been deliberately simplified in the interest of clarity, and collateral structure (e.g., lock nuts, seals, etc.) has been omitted. These abutment stops therefore provide adjustable limits for leftward and rightward movement of the spool relative to the body.

Spool 12 is mounted within the bore for sealing sliding movement therealong, and has circular vertical left and right end faces 38,39 arranged to face abutment stop surfaces 36,37, respectively. As previously noted, the spool has five axially-spaced lobes mounted on a common stem 40. Thus, proceeding from left-to-right in FIG. 1, these individual lobes are indicated at 41,42,43,44,45, respectively. The spool is so dimensioned and configured with respect to the bore and the various slots-and-passageways, that, when the spool is in a centered or null position relative to the body, as shown in FIG. 1, the right metering edge of left spool 41 is substantially zero-lapped with respect to the left supply slot 22; the left and right metering edges of middle lobe 43 are substantially zero-lapped with respect to return slots 23,24, respectively; and the left metering edge of right lobe 45 is substantially zero-lapped with respect to right supply slot 25. However, the left and right metering edges of intermediate control lobes 42,44 are shown as being symmetrically underlapped with respect to control slots 29,30, respectively. Lobes 41,43 and 45 are shown as being further provided with an alternating series of lands and grooves, the grooves being severally indicated at 46 in FIGS. 1A–1F, to provide a laminar sliding seal with the bore.

Referring now to FIG. 1A, the right metering edge of left lobe 41 is defined by the intersection of a rightwardly-facing annular vertical surface 48, and the outwardly-facing horizontal cylindrical surface 49 of the rightwardmost land 50. Assuming that the spool is concentrically mounted within the bore, land 50 is shown as having a radially clearance $c_1$ with respect to bore surface 19, whereas each of the other lands on the lobe has a smaller radial clearance $c_2$. The left edge of land 50 is coincidentally shown as being substantially zero-lapped with respect to slot 22, but this may readily be changed.

As best shown in FIG. 1B, the left metering edge of middle lobe 43 is defined by the intersection of a leftwardly-facing annular vertical surface 51, and the outwardly-facing horizontal cylindrical surface 52 of left land 53. Land surface 52 is shown as having a radial clearance of $c_1$, whereas, except as described herein, the other lands of middle lobe 43 all have a smaller radial clearance of $c_2$. Note that the right edge of land 53 is overlapped with respect to slot 23.

Referirng now to FIG. 1C, the right metering edge of middle lobe 43 is defined by the intersection of rightwardly-facing annular vertical surface 54, and the outwardly-facing horizontal cylindrical surface 55 of right land 56. Land surface 55 is spaced from bore wall 19 by a radial clearance of $c_1$, whereas all the other lands on the middle lobe (except for left land 53) have a radial clearance of $c_2$.

In FIG. 1D, the left metering edge of right lobe 45 is shown as being defined by the intersection of a leftwardly-facing annular vertical surface 58, and the outwardly-facing horizontal cylindrical surface 59 of left land 60. Land surface 59 is shown as having a radial clearance of $c_1$ with respect to the bore, whereas the other lands on this right lobe have a radial clearance of $c_2$.

As best shown in FIG. 1E, the left and right metering edges of left control lobe 42 are defined by the intersection of outwardly-facing horizontal cylindrical surface 61 with leftwardly- and rightwardly-facing annular vertical surfaces 62,63, respectively. As previously noted, both metering edges of this lobe are underlapped by a like distance, at null, with respect to control slot 29. Lobe surface 61 is spaced from bore wall 19 by a radial clearance $c_2$.

In FIG. 1E, right control lobe 44 is shown as having its left and right metering edges defined by the intersection of outwardly-facing horizontal cylindrical surface 64 with leftwardly- and rightwardly-facing annular vertical surfaces 65,66, respectively. Lobe surface 64 is spaced from bore wall 19 by a radial distance $c_2$. Thus, all five lobes have a radial clearance with respect to the bore wall of dimension $c_2$ except for the four end lands 50,53,56,60, each of which has a greater radial clearance $c_1$.

Spool 12 is configured such that when the spool is either in its null position (FIG. 1), its left hard-over position (FIG. 2), or its right hardover position (FIG. 3), intended flow to or from the control slots will be blocked. Thus, should the spool move to a left hard-over position at which spool left end face 38 abuts left abutment surface 36 (FIG. 2), left supply slot 22 and right return slot 24 are uncovered. However, the left metering edges of control lobes 42,44 overlap control slots 29,30, respectively, to prevent deliberate or intended flow to left control slot 29 and from right control slot 30. More particularly, as shown in FIG. 2A, the middle lobe left land 53, which was substantially zero-lapped at null, will now be overlapped with respect to slot 23 by an axial distance $L_1$. Similarly, the right lobe left land 60 will also be overlapped with respect to slot 26 by a like distance $L_1$, as shown in FIG. 2B. However, the spool left and right control lobes 42,44 will be overlapped with respect to control slots 29,30, respectively, by a smaller axial distance $L_2$, as shown in FIGS. 2C and 2D.

The converse or right hard-over position is shown in FIG. 3. Thus, should the spool move rightwardly such that spool right end face 39 abuts right stop surface 37, left return slot 23 and right supply slot 25 will be uncovered. However, the right metering edges of control lobes 42,44 will overlap control slots 29,30, respectively, to prevent intended flow from left control slot 29 and to right control slot 30. In this condition, left lobe right land 50 will be overlapped with respect to left supply slot 22 by an axial distance $L_1$, as shown in FIG. 3A. At the same time, middle lobe right land 56 will also be overlapped with respect to right return slot 24 by an axial distance $L_1$, as shown in FIG. 3B. However, the right metering edges of control lobes 42,44 will be overlapped with respect to control slots 29,30 by smaller axial dimensions $L_2$, as shown in FIGS. 3C and 3D.

The unique configuration of the spool may be advantageously employed to either balance or deliberately mismatch the leakage flows to and from the control slots in the event of a hard-over failure in either direction. The general equation for leakage flow (Q) between an overlapped lobe and a bore is:

$$Q = \frac{\pi D c^3[1 + 1.5(e/c)^2](P_u - P_d)}{12\,\mu L} \quad (1)$$

where D is the bore diameter, c is the radial clearance between the lobe (or land) and the bore, e is the radial eccentricity, $P_u$ is the upstream pressure, $P_d$ is the downstream pressure, $\mu$ is the fluid viscosity, and L is the length of the overlap. If the spool is assumed to be perfectly centered (i.e., e=0), if the same fluid is used (i.e., $\mu$=constant), and if the pressure in the control slots is approximately half of the differential between $P_s$ and R [i.e., $(P_u - P_d) = (P_s - R)/2$], then equation (1) simplifies to:

$$Q = \frac{Kc^3}{L} \quad (2)$$

where K is a constant.

To balance the leakage flows such that there will be substantially zero net leakage flow with respect to the control slots (i.e., $Q_{in} = Q_{out}$), then the relationship between the radial clearances and overlaps may be expressed as:

$$\frac{c_1^3}{L_1} = \frac{c_2^3}{L_2} \quad (3)$$

Thus, to balance the leakage flows, dimensions $c_1$, $c_2$, $L_1$, and $L_2$ may be selectively varied according to equation (3). Hence, if $c_1 > c_2$, then $c^3 > c_2^3$, and $L_1$ must therefore be greater than $L_2$, and so on.

Alternatively, the leakage flows may be deliberately mismatched (i.e., $Q_{in} > Q_{out}$, or $Q_{out} > Q_{in}$, as desired) in order to slew or bias the actuator to move in one direction in the event of a hard-over failure. For example, when the spool is in the left hard-over position shown in FIG. 2, if it is desired that there be a positive net leakage flow into control slot 29, say, $Q_{in} = 150\% Q_{out}$, then the relationship set forth in equation (3) can be expressed as:

$$\frac{c_2^3}{L_2} = 150\% \frac{(c_1^3)}{(L_1)} \quad (4)$$

In any event, if the spool is initially configured such that dimensions $L_1$, $L_2$ and $c_2$ are known, then the magnitude of enlarged radial clearance $c_1$ may be readily calculated to yield the desired result. In equating the leakage flows, as in equations (3) and (4), the viscosity term ($\mu$) drops out. Hence, the net leakage flow is unaffected by changes in temperature of the serviced fluid. In other words, while the individual leakage flows (i.e., $Q_{in}$ and $Q_{out}$) are a function of such viscosity, the effects of temperature are self-cancelling with respect to the net leakage flow.

FIG. 4 is a plot of flow (ordinate) verses spool displacement (abscissa) of one control slot for a spool configured to have substantially balanced leakage flows in either hard-over position. The ordinate expresses flow as a percentage of maximum flow. The abscissa expressed spool displacement as a function of electrical current (ma) supplied to the torque motor (not shown). Thus, the null position corresponds to a current of 50 milliamps (ma), while the left and right hard-over positions are represented by currents of 0 and 100 ma, respectively. From FIG. 4 it can be seen that within an operating range of about 40% of null (i.e., from about 25 ma to about 75 ma), flow through the valve will be substantially proportional to the supplied current. Thus, the valve operates as a conventional flow-control servovalve within this operating range. However, beyond this range, there are transitional regions during which flow begins to fall as the initially-underlapped control lobes begin to close the orifices communicating with the control slots, followed by extreme regions of zero intended flow in either direction. Since the leakage flows have been deliberately balanced in this example, there is substantially zero net leakage flow at null and at either hard-over position (i.e., i=0, i=0, i±100 ma). This represents the fail-fixed mode of operation.

Figure 5:
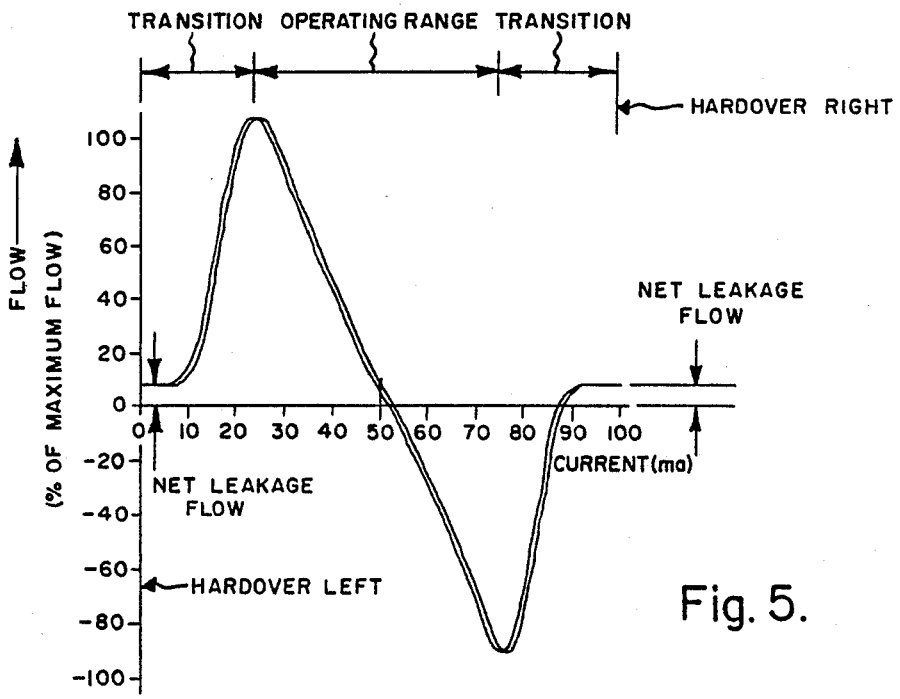
FIG. 5 is a graph showing flow (ordinate) verses supplied current (abscissa) for a fail-safe servovalve having deliberately mismatched leakage flows in both hard-over positions.
Figure 6:
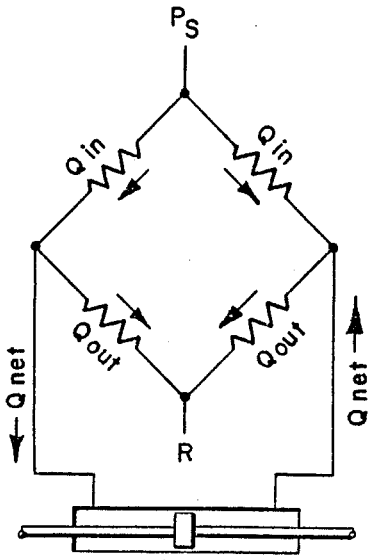
FIG. 6 is a schematic of a hydraulic bridge circuit in which the hard-over leakage flows are arranged to slew an actuator to the right.

FIG. 5 is a plot similar to FIG. 4, but shows the effect of deliberately mismatching the leakage flows such that there will be a deliberate net leakage flow, either positive or negative, in either hard-over position. The shape of the curve is substantially the same as that shown in FIG. 4, except that it has been shifted vertically relative to the coordinates. Hence, there is an intended net leakage flow in either hard-over position. This illustrates on form of a fail-safe mode of operation. As previously indicated, this can be used to deliberately slew an actuator toward a desired position in the event of a hardover failure in either direction, as shown in FIG. 6. This figure depicts a bridgelike hydraulic circuit in which the left leakage flows are deliberately mismatched matched so as to create a positive net flow to the actuator left chamber, while the right leakage flows are deliberately mismatched so to create a negative net flow from the actuator right chamber. Hence, as shown, the actuator will be biased to move rightwardly in the event of such hard-over failure. While the piston faces are shown as being of equal area, the principles of such slewing could be readily adapted to an actuator having such faces of unequal area.

MODIFICATIONS

The present invention contemplates that many changes and modifications may be made.

Figure 7A:
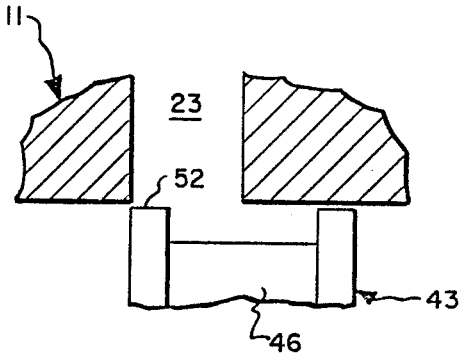
FIG. 7A is a fragmentary detail view showing a modified spool at null with respect to a return slot.
Figure 7B:
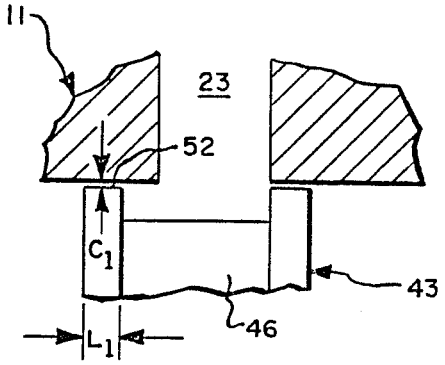
FIG. 7B is a fragmentary detail view of the structure shown in FIG. 7A, but depicts the spool as having been shifted leftwardly to a hardover position.

For example, while the preferred embodiment is shown as having its various supply and return lobes substantially zero-lapped, and having its control lobes symmetrically underlapped, at null, this arrangement may easily be reversed. In other words, the control lobes could be substantially zero-lapped, and the supply and return lobes underlapped, at null. The principles of the invention need not be incorporated in a four-way valve, as shown, and may be incorporated in a three-way valve as well. Indeed, the invention is not limited to use with a flow-control servovalve, or even a servovalve at all. The means for moving or shifting the spool relative to the body may be fluidic, mechanical, electrical, or manual, as desired. Similarly, the valve may service various fluids (i.e., either liquids or gases). For manufacturing convenience, it is presently preferred to selectively grind the spool so as to provide the enlarged radial clearances on the various spool lobes. However, such radial clearances could alternatively be provided by having a stepped bore. Mismatched leakage flows may also be provided by holding the radial clearances constant, and varying the respective overlap lengths. In other forms, such as shown in FIG. 7A, the radial clearance may be constant (i.e., $c_1=c_2$), and groove 46 widened so that one land has a fixed overlap length $L_1$ when the spool moves to a leftward hard-over position. This configuration has the advantage that the relationship of $L_1$ to $L_2$ (not shown in FIGS. 7A and 7B) may be varied by adjusting the position of the spool stop relative to the body, since $L_2$ varies with spool position but $L_1$, once overlapped, does not. Moreover, this configuration has the accompanying advantage of not providing for increased leakage flows at null.

Moreover, the principles of the invention may be employed with valve spools having other than a laminar land-and-groove outer surface. For example, land 53 could have the same clearance as land 42, but be provided with a "V" notch in its overlapped edge, or a narrow groove formed across its surface. In either case, such notch or groove being dimensioned and proportional to create a flow restriction approximately matched or ratioed to the flow restriction formed by overlap $L_2$ and clearance $c_2$. Another alternative would be to locate groove 46 so that it opened into slot 23 as land 42 closed off slot 29, and to provide a restricted through lobe 53. The flow impedance of this restricted passage would, of course, be matched or ratioed to the impedance of land 42. Such lobes, as well as the enlarged radial clearance portion, need not by symmetrical.

Therefore, while a preferred embodiment of the improved fail-fixed servovalve has been shown and described, and several modifications thereof discussed, persons skilled in this art will readily appreciate that various additional changes and modifications may be made without departing from the spirit of the invention, as defined and differentiated by the following claims.

We claim:

1. In a valve having a body provided with a bore; having supply, control and return slots extending into said body from said bore, said supply slot communicating with a source of pressurized fluid, said return slot communicating with a fluid return; having a valve spool operatively arranged in said bore for sliding movement between a null position and an alternative position, said spool having supply, control, and return lobes adapted to cooperate with said supply, control and return slots, respectively; each lobe being so configured and arranged with respect to its associated slot that when said spool is moved from said null position toward said alternative position, fluid is constrained to flow between said control slot and one of said supply and return slots by passing sequentially through two variable orifices, the improvement which comprises:

said control lobe and at least one of said supply and return lobes being so dimensioned and proportioned with respect to their associated slots that when said spool is in said alternative position, one of said supply and return slots is opened, the other of said supply and return slots is closed, said control lobe blocks intended fluid flow between said control slot and such opened slot, and the ratio of impedance to leakage flows to and from said control slot is substantially equal to a predetermined value.

2. The improvement as set forth in claim 1 wherein, when said spool is in said null position, said control lobe is underlapped with respect to said control slot.

3. The improvement as set forth in claim 1 wherein, when said spool is in said null position, said one of said supply and return lobes is substantially zero-lapped with respect to its associated slot.

4. The improvement as set forth in claim 1 wherein, when said spool is in said null position, each of said supply and return lobes is substantially zero-lapped with respect to its associated slot.

5. The improvement as set forth in claim 1 wherein said alternative position is a hard-over position of said spool.

6. The improvement as set forth in claim 1 wherein, when said spool is in said alternative position, said one lobe is overlapped with respect with its associated slot by a first axial length, and said control lobe is overlapped with respect to its associated slot by a second axial length.

7. The improvement as set forth in claim 6 wherein said first length is greater than said second length.

8. The improvement as set forth in claim 7 wherein the radial clearance between said one lobe and said bore is greater than the radial clearance between said control lobe and said bore.

9. The improvement as set forth in claim 8 wherein the radial clearance between said one lobe and said bore is substantially equal to the product of the radial clearance between said control lobe and said bore and the cube root of the ratio of said first and second lengths.

10. The improvement as set forth in claim 8 wherein the ratio of the radial clearances between said one lobe and bore and said control lobe and bore is inversely related to the ratio of said second length to said first length.

11. The improvement as set forth in claim 1 wherein said impedance ratio is substantially equal to one.

12. The improvement as set forth in claim 1 wherein said impedance ratio is other than one, such tht there is a net leakage flow with respect to said control slot.

13. The improvement as set forth in claim 1 wherein when said spool is in said alternative position, the pressure differential between said supply and control slots is substantially equal to the pressure differential between said control and return slots.

14. The improvement as set forth in claim 1 wherein said valve is the second-stage of a two-stage electrohydraulic servovalve.

* * * * *